United States Patent [19]

Punako et al.

[11] Patent Number: 4,682,832

[45] Date of Patent: Jul. 28, 1987

[54] RETAINING AN INSERT IN AN ELECTRICAL CONNECTOR

[75] Inventors: Stephen Punako, Bainbridge; David O. Gallusser, Oneonta, both of N.Y.; Warren R. Williams, Jr., Montrose, Pa.

[73] Assignee: Allied Corporation, Morris Township, N.J.

[21] Appl. No.: 781,156

[22] Filed: Sep. 27, 1985

[51] Int. Cl.[4] ..... H01R 11/00

[52] U.S. Cl. ..... 439/589; 29/523; 29/520; 29/876; 439/278

[58] Field of Search ..... 339/59–61; 29/520, 521, 523, 876, 881, 882

[56] References Cited

U.S. PATENT DOCUMENTS

| | | | |
|---|---|---|---|
| 1,914,109 | 6/1933 | Cardieux | 339/24 |
| 2,865,011 | 12/1958 | Dejadon | 339/150 |
| 2,974,400 | 3/1961 | Sowa | 29/135.55 |
| 3,909,936 | 10/1975 | Ray | 29/629 |
| 4,019,799 | 4/1977 | Bouvier | 339/59 R |
| 4,053,200 | 10/1977 | Pugner | 339/177 R |
| 4,059,330 | 11/1977 | Shirey | 339/177 R |
| 4,062,612 | 12/1977 | Evans | 339/94 A |
| 4,063,351 | 12/1977 | Borsuk et al. | 29/629 |
| 4,099,323 | 7/1978 | Bouvier | 29/629 |

*Primary Examiner*—Gil Weidenfeld
*Assistant Examiner*—Paula A. Austin
*Attorney, Agent, or Firm*—C. D. Lacina; R. H. Criss

[57] ABSTRACT

A tubular sleeve of a deformable plastic is longitudinally slotted to define a plurality of laterally separated axially weakened longitudinal columns (62) the respective forward leading edges (64) of which being inserted into an annular passageway (32) formed between an insert (20) disposed in a shell (10) so that the columns curl about and the column medial portions (66) collapse in an accordian-like fashion whereby to radially interferencingly wedge and lock the columns in the passage and thereby to retain the insert in the shell. The curling could be 180° causing the leading edges to retreat coaxially rearward or be 270° causing the leading edges to loop about and be driven radially outward, the leading edges in either possibly engaging its rearward medial portion.

12 Claims, 9 Drawing Figures

RETAINING AN INSERT IN AN ELECTRICAL CONNECTOR

This invention relates to a separable electrical connector having an improved arrangement for retaining an insert within a shell.

An electrical connector of the type herein includes a dielectric insert which is retained in a metallic shell and carries a plurality of conductive terminals in electrical isolation from the shell for mating with a respective plurality of terminals in a second connector. The dielectric insert is typically hard and comprised of a thermoset or a thermoplastic material with good dielectric properties for circuit isolation.

Previous approaches for retaining an insert assembly within its shell have included upset staking of the shell, metal ring staking, and copper mesh/epoxy laminate staking. Each of these offer excellent retention but may introduce a conductive path between the insert assembly and shell. In "Electrical Connector" U.S. Pat. No. 4,019,799 and "Method of Making Electrical Connector" U.S. Pat. No. 4,099,233 issuing to Bouvier, respectively, Apr. 26, 1977 and July 11, 1978 and each incorporated herein by reference, it has been found that deforming the conductive mesh laminate by a crushing action caused the mesh to invade into the bond interface between a hard wafer and a resilient grommet whereupon a conductive path could be established between the outer row of terminals and the shell thereby causing a ground short to exist.

Other approaches have included epoxy staking, interference fits with epoxy, and self-snaping mechanisms, all of which protect against a conductive path to the shell but do not offer a good insert retention system. The epoxy does not have an internal reinforcement to prevent break up under extreme conditions of temperature and pressure. Further, the interference fits with epoxy rely on the epoxy to take up sloppy fits due to tolerancing. Self snapping mechanisms introduce loose inserts due to tolerancing difficulties.

Another approach has utilized a non-metallic laminate mesh. This offers good retention and assures a non-conductive path between the insert and shell but is hard to handle and process.

Provision of a non-conductive insert retention system that would be inexpensive, adaptable to a wide range of connector shells having different diameters and internal cross-sections, easy to manufacture, easy to assemble, and assure the user of insert retention integrity would be desirable.

This invention contemplates an electrical connector comprising a metal shell that includes an annular groove on its inner wall, a dielectric insert having an outer periphery disposed in the shell so that an annular passageway is provided between the shell and insert, and a retention arrangement for retaining the insert in the shell.

In accordance with this invention, a retention member comprised of a thermoplastic material is longitudinally slotted along its front face to provide a plurality of axially weakened columns that terminate in a leading edge each of which will curl back 180° upon themselves to lock the forward end portion of their respective column and each being forward of the respective column medial portion each of which being weakened to collapsingly fold and stack in accordion like fashion to form radial folds, the columns being curled and folded after the leading edges have engaged an axial wall of the annular groove at the end of the passageway and both the curled and folded column portions being interferencingly wedged in and filling the passageway about the annular passageway between the insert and the shell.

BRIEF DESCRIPTION OF THE DRAWINGS

Referring now to the drawings, FIG. 1 illustrates a metallic cylindrical connector shell 10, a cylindrical dielectric insert 20, an insert retention member 44, and an insert tool 33 each coaxially aligned for assembly along a central axis. The insert and shell have complementary cross-sections and when the dielectric insert is fitted into the shell, a coaxially extending annular passageway 32 is formed for receiving the insert member.

Figure 1:
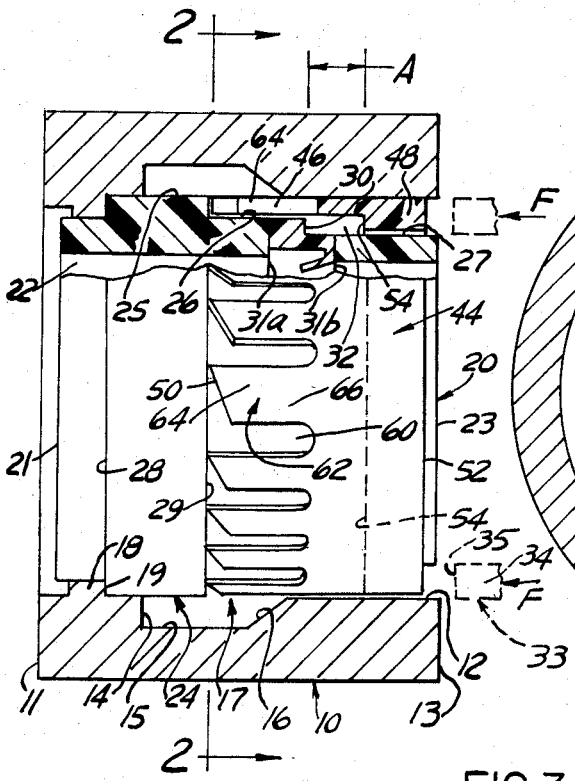
FIG. 1 is a side view in partial cross-section of a connector assembly including a dielectric insert disposed in a connector shell and a tubular retention member positioned in an annular passageway formed between the shell and insert.

The shell 10 is open at each of its opposite axial ends and includes a mating forward end 11, a rearward end 13, and an inner wall 12 having an annular groove 17 and an inward radial flange 18. The annular groove comprises an axial face 14 disposed in a plane generally perpendicular to the central axis and facing rearwardly, a tapered frusto-conical axial face 16 facing forwardly, and an annular wall 15 extending between the faces generally coaxially to the inner wall. The flange 18 includes an endwall 19 that faces rearwardly and provides a stop which limits inward axial insertion of the insert into the shell.

The insert 20 is typically comprised of Torlon and includes a front face 21, a rear face 23, and a plurality of passages 22 extending between the faces for receiving an electrical contact (not shown). The cross-section of the insert is stepped and has an outer periphery defined by a cylindrical first, second and third surface 25,26,27 each surface being generally coaxial to the central axis of the insert with the first and third surfaces 25,27 extending, respectively, from the front and rear faces 21,23, the first surface 25 defining a collar 24, the second surface 26 being encircled by the annular groove 17 and the second and third surfaces 26,27 being radially separated by a shoulder 30. The collar 24 includes axial faces 28,29 with the face 28 facing forwardly and abutted against endwall 19 of the radial flange, and the first surface 25 thereof clearance fit within the inner wall 12 of the shell 10 so as to position the axial face 29 of the collar medially of the annular groove 17. As shown, three cylindrical members are bonded together into the single insert with respective passages in each being aligned for receiving contacts and bond interfaces being indicated at 31*a, b.*

The retention member 44 comprises a tubular sleeve formed from a stepped flat sheet of a thermoplastic material, the sleeve including a forward and a rearward end portion 46,48 with the forward end portion 46 being substantially thinner than the rearward end portion 48. The forward end portion has a front face 50 scalloped by longitudinal slots 60 extending therefrom towards the rear face 52 of its rearward end portion 48. A suitable material would be resiliently deformable and not crackable, comprise a thermoplastic material with good properties of elongation, shear strength and high temperature capability. Such a thermoplastic material includes a polyethersulfone and a polyetherimide.

The longitudinal slots 60 define a plurality of laterally spaced and axially weakened columns 62 each including a forward end portion and a medial portion 66, the forward end portion of each column including a leading edge 64 which is adapted to curl 180° about itself upon contact with the axial face 14 and the medial portion 66 being adapted to foldingly stack upon itself in accordion like fashion simultaneously with the curling of the leading edges. The leading edges are acutely angled and terminate in a sharp tip, the slanting aiding in insertion and weakening the tip portion so as to aid in initiating a rolling or curling of the tip. The locus of tips define a common plane perpendicular to the axis of the sleeve when the sheet is wrapped about to form the tubular sleeve whereby upon insertion of the sleeve the tips will simultaneously contact their intended surfaces.

The retention member has generally parallel top and bottom faces for each of its forward and rearward end portions 46, 48, the rearward end portion being the thicker of the two and defining a forwardly facing endwall 54 which is adapted to engage the shoulder 30 of the insert 20 whereby to trap the rearward end portion of the multi-piece integrally bonded insert within the shell. Each column 62 adjacent to its leading edge 64 and extending rearwardly therefrom could increase in thickness to enhance curling.

As shown, retention member 44 is positioned so that the leading edges 64 of the columns 62 and their associated tips are adjacent to the collar 24 and the endwall 54 is spaced an amount "A" from shoulder 30 of the collar. The retention member 44 is inserted inwardly into the passageway 32 from the rearward end 13 of the shell by a force "F" applied by the insertion tool.

The insertion tool 33 includes a cylindrical mandrel 34 having a front action surface 35 adapted to engage the rear face 52 of the retention member 44 whereby to drive the retention member into the annular passageway 32 formed between the inner wall of shell and the outer periphery of the insert when the insert is inserted within the shell.

Figure 2:
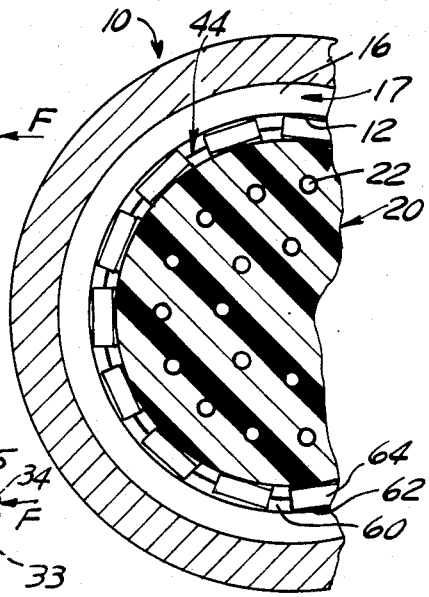
FIG. 2 is a view taken along line II—II of FIG. 1 showing the retention member positioned in the annular passageway.

FIG. 2 shows the retention member 44 disposed about the insert 20 and the columns 62 disposed generally equiangularly thereabout.

Figure 3:
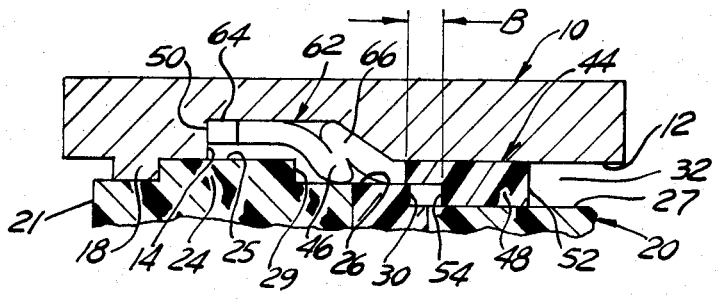
FIG. 3 is a side view similar to FIG. 1 showing further inward insertion of the retention member into the annular passageway.

FIG. 3 shows further insertion of the retention member 44 into the shell whereby the endwall 54 has advanced towards and is spaced an amount "B" from the shoulder 30 of the insert 20. The leading edges 64 of the columns 62 are adjacent to the axial wall 14 of annular groove 17 and the medial portion 66 of the columns are in the annular passageway 32.

While the rearwardly facing axial face 29 of collar 24 is shown as being substantially at a right angle, a chamfer (i.e., tapered) surface would also work.

Figure 4:
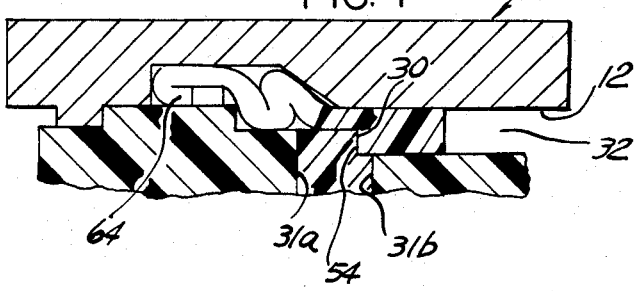
FIG. 4 is a side view similar to FIG. 3 showing the retention member finally inserted into the annular passageway.

FIG. 4 shows the result of continued insertion of the retention member 44 into the passageway. The leading edges 64 after being driven into engagement with the rearwardly facing axial face 14 of the annular groove 17 curl about 180° and fold backwardly upon themselves and lockingly, radially, interference fit within the annular cavity defined by the annular groove 17 and outer periphery 25. The thickness of the leading edge is slightly greater than half that dimension defined between annular wall 14 of annular groove 19 and outer periphery 25 to enhance locking/wedging. The tips, preferably, will be driven back and against their respective medial portion 66. The medial portion 66 of the columns 62 collapse in an accordion-like fashion whereby to fold over themselves and have portions thereof driven radially upward as the column folds stack. Portions of the folded accordion are interferencingly wedged within the annular groove and around the insert whereby to engage the insert and shell. When the endwall 54 abuts the shoulder 30 of the insert 20, as shown, the assembler knows that the inserting operation is complete.

Figure 5:
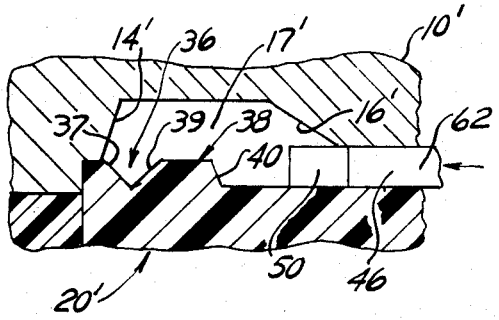
FIG. 5 is a side view of a connector assembly and the tubular retention member positioned in an annular passageway.
Figure 6:
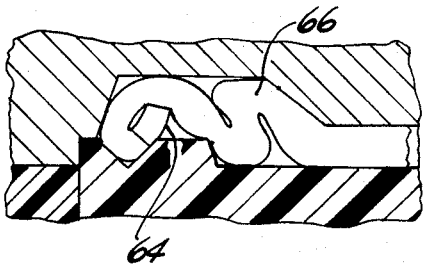
FIG. 6 is a side view similar to FIG. 5 showing the retention member when assembled.

FIGS. 5 and 6 show a retention member 44 being inserted into an annular passageway between a shell 10' and an insert 20'. The shell includes an annular groove 17' having a rearward frusto-conical face 16' that defines a cam surface which tapers at an acute angle to the connector axis. The insert 20' includes a collar comprised of a V-shaped annular recess 36 contiguous with an annular rib 38 with the recess being defined by a frusto-conical forward and rearward cam face 37,39 and the rib being defined by a frusto-conical forward and rearward cam face 39,40, cam face 39 being common to each and the cam faces of said rib being at an acute angle to the connector axis and defined by a line intersecting at a point about the insert so as to define a pair of cam surfaces. The respective cam faces cause the plurality of leading edges to be driven radially outward or inward, depending on surface driven against.

FIG. 5 shows a leading edge 62 approaching the annular rib 38 and its cam face 40.

FIG. 6 shows a completed insertion of the retention member 44. The weakened, slanted, leading edges first engage cam face 40, are driven radially upward into the annular groove 17' and axially inward and against the axial face 14' and radially downward against cam face 37 of the recess 36, then backwardly against the cam face 39 of the recess 36 and radially outward and against the medial portion 66 which trails and foldingly, wedgingly collapses in the passageway. The leading edge of each rolls and curls about itself 180° and forms a wedged radial lock at the forward end portion of the column. As shown, the leading edge 64 loops about 270° about itself relative to the insertion direction.

Figure 7:
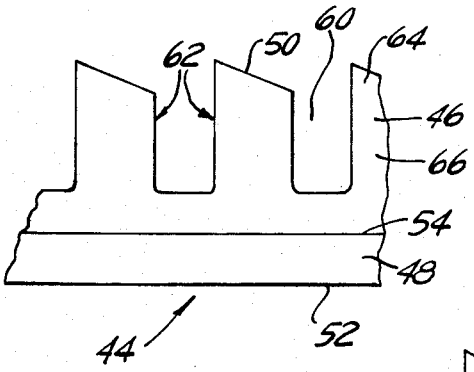
FIGS. 7–9 shows plan views of a retention member.
Figure 8:
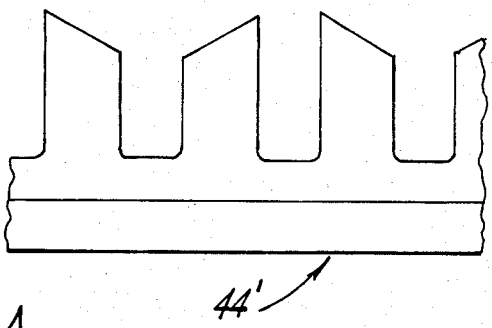
Figure 9:
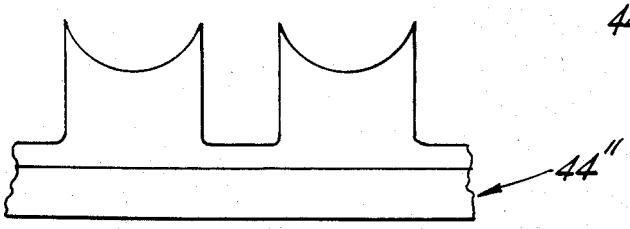

FIGS. 7–9 shows the retention member 44 as being formed from an elongated-continuous strip of non-conductive thermoplastic material. Longitudinal slots 60 each extend rearwardly whereby to define a plurality of laterally separated weakened axial columns 62 which are adapted to both curl and to collapse upon a sufficient external force being placed on them. The respective strips are wrapped around to form a tubular sleeve having a cross-section sized for insertion into the annular passageway. The shape of the slots 60, while shown as being U-shaped, could be otherwise. FIGS. 7,8 and 9 show columns wherein the leading edges include an acutely angled tip and a pair of tips.

We claim:

1. In an electrical connector assembly of the type including a cylindrical shell having an annular groove in its inner wall, a cylindrical insert disposed within said shell and having an outer periphery encircled by said groove with the inner wall and the outer periphery being dimensioned so as to form an annular passageway extending coaxially therebetween, and retention means for retaining the insert within said shell, said retention means comprising a cylindrical retention member of deformable material including a scalloped forward end portion thereof interferencingly fit in the annular passageway between the shell and the insert, said retention means characterized in that a leading edge of each said scallop is curled backwardly and folded into overlapping relation onto itself whereby the curled overlapped scallops of the forward end portion are radially wedged interferencingly in the annular groove and in the annular passageway and lock the leading edges therewithin.

2. The connector assembly as recited in claim 1 wherein said annular groove includes an axial face facing rearwardly, said retention member comprises an elongated strip of nonconductive material cylindrically formed into a sleeve sized to fit within said passageway, and said scalloped forward end portion comprises a front face and plurality longitudinal slots each extending longitudinally rearward from the front face to define a plurality of laterally spaced and axially weakened columns, the front face of each said column including a leading edge which curls about itself upon contact with the axial face during fitment of the sleeve in the passageway.

3. The connector assembly as recited in claim 2 wherein each said column includes a front portion which extends rearwardly from the leading edge and into a medial portion thereof, said medial portion foldingly stacking upon itself in accordion like fashion in the annular passageway and at a column location rearwardly of the curled leading edge.

4. The connector assembly as recited in claim 2 wherein each said column has a medial portion and said forward end portion has a thickness dimension approximately half of the dimension of said passageway, said forward end portion being curled so that each said leading edge thereof is driven longitudinally rearward in a direction generally parallel to the sleeve axis and against its respective medial portion whereby to lock the curled portion therewith, said annular groove receiving some of the forward end portion of each said column collapsingly curled therein.

5. The connector assembly as recited in claim 2 wherein the outer periphery of said insert encircled by said annular groove includes an annular rib and a V-shaped annular recess, said recess being circumjacent to the axial face of said annular groove and each said annular groove and annular recess forming an annular cavity for the curled front portion to radially wedge within with the leading edge of each said column being driven radially outward and against its respective medial portion whereby to lock the curled portion therewithin.

6. The connector assembly as recited in claim 5 wherein said annular rib includes a frusto-conical forward and rearward surface each at an acute angle to the connector axis and defined by a line intersecting at a point about the insert so as to define a pair of cam surfaces each which cam the plurality of leading edges radially outward towards said annular groove, the rearward surface forming a cam to drive each said leading edge radially outward and against its medial portion whereby the forward end portion curls about itself and drives the medial portion radially outward into and against the annular groove.

7. The connector assembly as recited in claim 2 wherein each said leading edge curls approximately 180° relative to its respective forward end portion.

8. The connector assembly as recited in claim 7 wherein each said leading edge terminates in a sharp tip and the locus of tips define a common plane perpendicular to the axis of the retention member.

9. A method of retaining a generally cylindrical insert within a generally cylindrical shell having a forward and a rearward end, the inner wall of the shell including an annular groove to provide an axial face facing rearwardly, and an annular passageway being defined coaxially between the insert and the shell, the steps of the method including:

reducing the cross-section of the insert whereby to provide a stepped insert having a radial collar therearound, said radial collar defining a pair of annular surfaces, inserting the insert into the rearward end of said shell so that one annular surface is circumjacent to the axial face and the other annular surface is encircled by the annular groove, removing from an elongated strip of plastically deformable non-conductive material a plurality of strip portions whereby to define a strip member having a plurality of scallops in the form of laterally separated longitudinal columns, each column terminating at a leading edge with the thickness of each column being approximately half that of the annular passageway circumposed by said groove.

forming the strip member into a cylindrical sleeve having a cross-section corresponding to that of the annular passageway; and axially inserting the sleeve into the passageway a distance sufficient that the leading edges of said columns engage the axial face with continued insertion being with an external force sufficient to cause the leading edges of each column to curl backwardly and upon themselves into overlapping relationship and radially wedgingly fill the passageway with the curled overlapped edges whereby to lock the columns therewithin.

10. The method as recited in claim 9 including the steps of tapering the leading edges so as to provide each column with a forward portion which is thinner than a medial portion thereof and the inserting causing the medial portion of each column foldingly collapsing within the passageway.

11. A method of retaining a generally cylindrical insert within a generally cylindrical shell, an outer diameter of the insert being slightly less than an inner diameter of the shell so as to define a coaxially extending annular passageway between said shell and said insert, said shell including an annular groove having an axial face facing axially rearward, and said insert including an annular collar encircled by said groove, the steps of the method characterized by:

forming a cylindrical sleeve from a piece of deformable nonconductive material, said cylindrical sleeve having a forward and a rearward end and a plurality of generally equiangularly spaced slots extending inwardly from said forward end to define an annulus of axially weakend longitudinal columns, each respective column terminating in a leading edge and having a thickness about half that of said passageway, and coaxially inserting the forward end of the sleeve into the annular passageway until the respective leading edges engage the axial face and then increasing the insertion force an amount sufficient to cause the leading edge of each column to curl backwardly 180° and into overlapping contact with a portion of itself whereby to form a locked wedged portion therewithin.

12. The method as recited in claim 9 wherein the axial face defines a frusto-conical cam surface which faces axially rearward, the reducing step provides a V-shaped annular recess and an annular rib with each including, respectively, a pair of axially facing frusto-conical cam faces on cam face facing axially rearward and the other cam face facing axially forward, the forward cam face of said recess being circumjacent to the cam surface and the rearward cam face of said recess also being the forward cam face of said rib, and the inward inserting step simultaneously drives the leading edges radially inward from the cam surface and against the rearward cam face of the recess, then axially rearward and against the forward cam face of the recess whereby to be driven radially outward whereupon the leading edges invade the annular recess and curl about themselves to wedgingly interference fit within the annular cavity formed between the recess and groove.

* * * * *